US007007613B2

(12) United States Patent
Sketo

(10) Patent No.: US 7,007,613 B2
(45) Date of Patent: Mar. 7, 2006

(54) FOLDABLE PALLET WITH MINIMIZED USE OF MATERIAL AND HAVING SELF-LOCKING FASTENERS

(76) Inventor: James L. Sketo, 2914 Orchard Walk, Jonesboro, GA (US) 30236

( * ) Notice: Subject to any disclaimer, the term of this patent is extended or adjusted under 35 U.S.C. 154(b) by 129 days.

(21) Appl. No.: 10/703,964

(22) Filed: Nov. 7, 2003

(65) Prior Publication Data

US 2005/0098067 A1 May 12, 2005

(51) Int. Cl.
*B65D 19/00* (2006.01)

(52) U.S. Cl. ..... 108/51.3

(58) Field of Classification Search ..... 108/51.3, 108/51.1, 57.26, 56.1, 57.3, 57.32; 206/386; 248/346.02

See application file for complete search history.

(56) References Cited

U.S. PATENT DOCUMENTS 2,908,464 A * 10/1959 Traudt et al. ..... 108/51.3
2,913,206 A * 11/1959 Paris ..... 206/386
3,232,252 A * 2/1966 Nelson ..... 108/115
3,464,370 A * 9/1969 Martin ..... 108/51.3
4,875,419 A * 10/1989 Helton et al. ..... 108/56.1
4,936,229 A * 6/1990 Parnell ..... 108/51.3
5,285,732 A * 2/1994 Gottlieb ..... 108/51.3
5,452,667 A * 9/1995 Lim ..... 108/51.3
5,528,995 A * 6/1996 Lim ..... 108/56.1
5,660,119 A * 8/1997 Perkins ..... 108/51.3
5,937,767 A * 8/1999 Togawa et al. ..... 108/57.26

* cited by examiner

*Primary Examiner*—Jose V. Chen
(74) *Attorney, Agent, or Firm*—Harry I. Leon; Vivian L. Steadman

(57) ABSTRACT

A pallet assembled from two sheets of material, preferably corrugated paper board stamped with cutouts. Once the cutouts have been scored, the two sheets are then either manually or machine folded to form upper and lower frame members. The frame members are then interconnected, using barbed arrow-shaped fasteners and slots, in such a way as to create a force-resisting structure. Each of the fasteners is fabricated as a single, unitary piece with one of the frame members. No glue or other fasteners are required. In the pallet, the barbed arrow-shaped fasteners lock together upper and lower column elements within the frame members. Arrayed in contiguous pairs, the column elements are aligned so that each upper column element is disposed side by side with a lower column element, forming a single column of double thickness when the contiguous column elements are locked togehter. End flaps which bound the perimeter of the completed pallet are locked into position with the use of barbed arrow-shaped fasteners which are similar to those used in the column elements.

9 Claims, 10 Drawing Sheets

FOLDABLE PALLET WITH MINIMIZED USE OF MATERIAL AND HAVING SELF-LOCKING FASTENERS

BACKGROUND OF THE INVENTION

1. Field of the Invention

Pallets have been used for many years as supports for a wide variety of goods. Pre-packaged in separate small units and secured atop individual pallets, goods can then be lifted and moved around with the use of fork lift trucks. Traditionally, pallets have been made entirely of wood, but such combinations are not only expensive to construct but also bulky to store and difficult to recycle. There is a need for low cost, easy to store and recyclable pallets. Pallets which can be easily fabricated in a wide range of custom sizes are also highly desirable.

2. Description of Related Art

Only a few inventors have disclosed pallets which approach the ideal, i.e., a pallet which can be formed when needed and otherwise be stored in a configuration in which it has only the thickness of a thin sheet of material, thereby saving storage and transportation costs. Among the pallets which represent an attempt to achieve this ideal is a foldable corrugated pallet assembly disclosed by Ogilvie, Jr. et al., U.S. Pat. No. 6,029,582, issued Feb. 29, 2000, hereinafter referred to as "Ogilvie".

Made from two precut and folded corrugated sheets, Ogilvie's pallet assembly is formed by rotating an upper frame member through 90 degrees relative to the lower frame member, and then placing it upside down over the lower frame member. So placed, ribs, which are formed in the upper frame member by a pleat-like folding of one of the corrugated sheets, extend perpendicularly to ribs which are formed in a like fashion in the lower frame member. Ogilvie's pallet assembly is completed by locking the ribs of the lower frame member into slots defined by the ribs of the upper frame member; and the latter ribs in turn are locked into slots defined by the ribs of the lower frame member. Glue is used to keep the pleat-like folds of the ribs intact.

SUMMARY OF THE INVENTION

The object of the present invention is to provide a lightweight pallet which can be shipped as flat sheets, whether precut or not, and which can be economically assembled as needed by the user.

A further object is to provide such a pallet whose assembly does not require the use of glue or any fasteners other than those which are an integral part of the flat sheets themselves, thereby making the assembly and recycling much easier.

A still further object with the present invention is to provide such a pallet which requires substantially less material to form the same size pallet as do prior art combinations.

In accordance with the present invention, there is provided an improved pallet assembly made from two precut and folded frame members in which the upper frame member is rotated 90 degrees relative to the lower frame member and placed upside down over the lower frame member, both frame members defining column elements which in the pallet assembly are aligned side by side in pairs. So aligned, the column elements form a plurality of columns, each column having one column element from the upper frame member and one column element from the lower frame member. Preferably, each column element defines a self-locking tab which comprises both a barbed arrow-shaped fastener and a slot for receiving the tip of a second such fastener. In the completed pallet assembly, the barbed tip of each such fastener on a column element of the upper frame member is held within a slot defined by a contiguous column element from the lower frame member. Similarly, the barbed tips of the fasteners on column elements of the lower frame member are held within slots in contiguous column elements of the upper frame member.

In the preferred embodiment, each barbed arrow-shaped fastener on an individual column element is nestled within a portion of a cutout which becomes a slot defined by this same column element when the barbed tip of the fastener and its shaft are dislodged from the cutout, in preparation for the tips being inserted into a similar slot defined by a contiguous column element.

Shipped as a pair of flat sheets preferably made from corrugated paper board, the frame members can be formed and assembled manually or with the use of a relatively inexpensive machine. In addition, each of these sheets defines a plurality of self-locking tabs, independent of the column elements, which, in the completed pallet assembly, further lock the frame members together to form a rigid pallet. Thus neither material-consuming pleats nor glue nor any fasteners other than those which are an integral part of the flat sheets themselves are required in the fabrication of the improved pallet assembly. The saving on material alone over Ogilvie's combination amounts to about 20% for the same size pallet.

The pallets of this invention can be made of any length, width and thickness size without a cost penalty. Further the pallet can be made from a wide variation of materials including corrugated paper, sheet and corrugated plastic, and even ductile metals. An additional advantage can be had in a square pallet in which the pallet is constructed of two identical sheets of flat material, each being precut with the same pattern of cutouts, except for one of the sheets defining openings for receiving the wheels of a jack pallet, when the latter is needed.

BRIEF DESCRIPTION OF THE DRAWINGS

FIG. 4A shows a first locking tab defined by a column element in the upper frame member just before the first locking tab is engaged with a slot on a contiguous column element in the lower frame element;

FIG. 4B shows the initial stage of engagement between locking tabs in contiguous column elements, in which the tip of a second locking tab defined by the column element in the lower frame member is engaged with a slot defined by the column element in the upper frame member;

FIG. 4C shows the final stage of engagement between locking tabs in contiguous column elements and how the tool is used to pull the tip of the first locking tab into a slot defined by the column element in the lower frame member;

FIG. 4D shows the final locking of the tabs of contiguous column elements when the tool is disengaged;

FIG. 4E shows a plurality of contiguous column elements with their respective locking tabs fully engaged;

DETAILED DESCRIPTION OF THE PREFERRED EMBODIMENT

Figure 6:
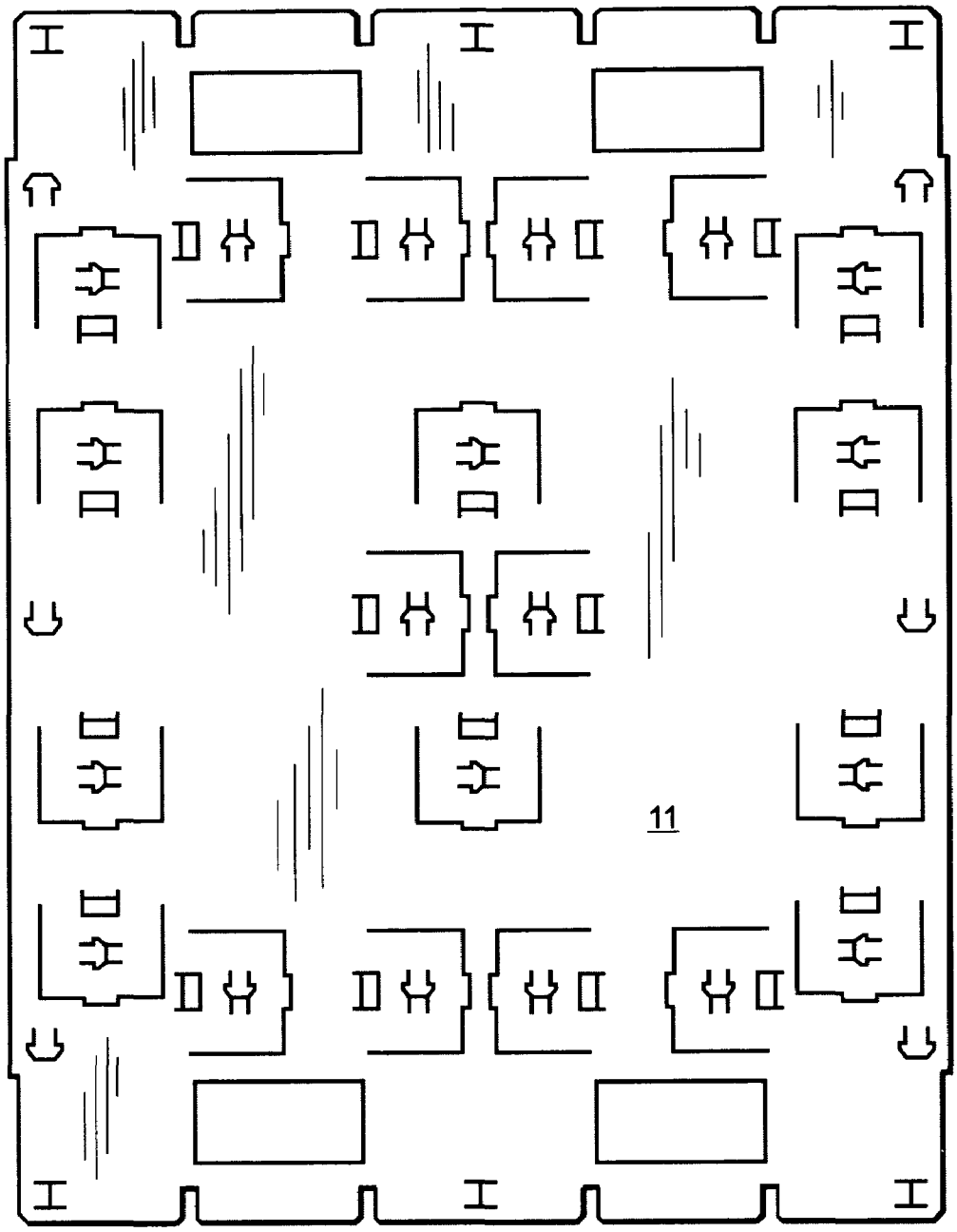
FIG. 6 is a plan view of the upper frame member of the pallet that has been scored and readied for shipment or for folding.
Figure 7:
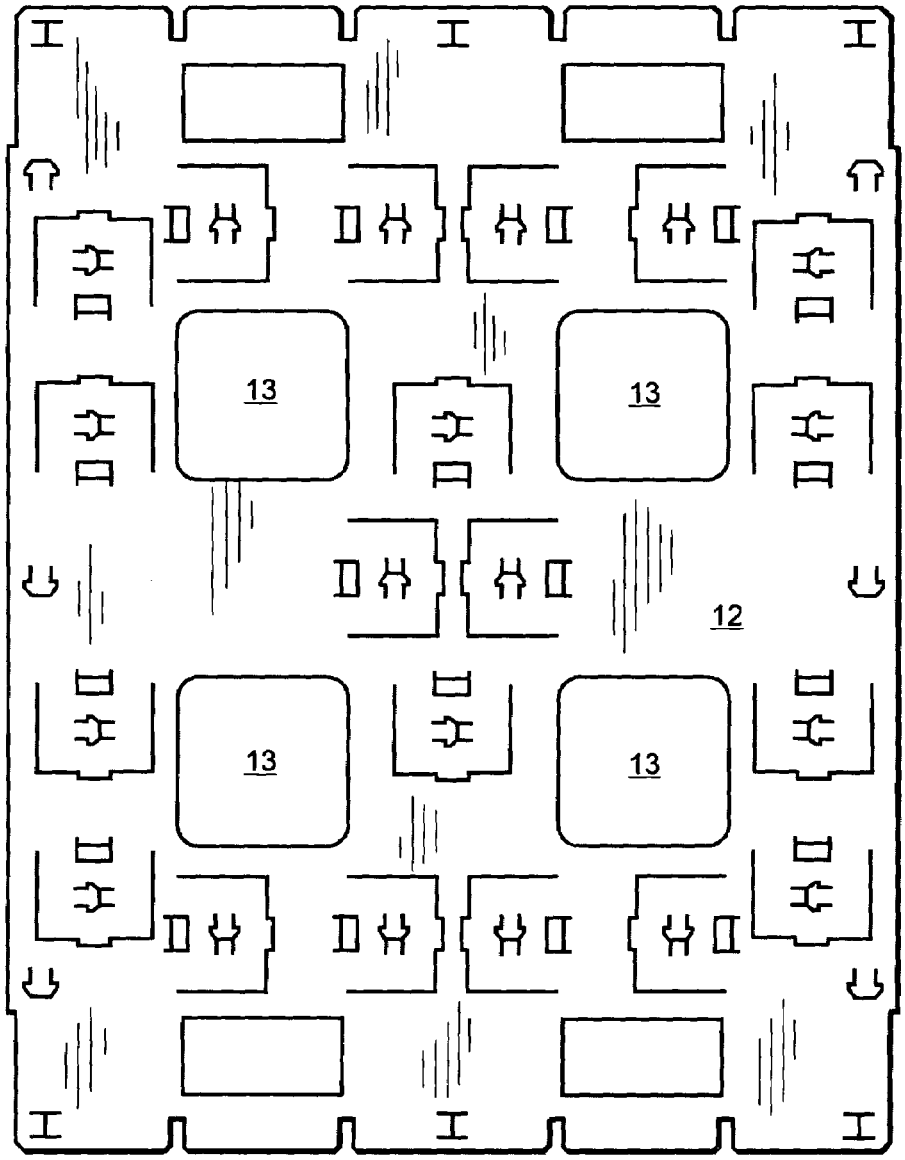
FIG. 7 is a plan view of the lower frame member of the pallet that has been scored and readied for shipment or for folding.

In the drawings, an improved pallet assembly is indicated generally by the reference numeral 10. Preferably rectangular in footprint, the pallet assembly 10 is fabricated by folding each of two precut sheets to form the upper and lower frame members 11, 12, respectively. The sheets 11, 12 can be made of a variety of materials including corrugated paper board, plastic or ductile metals or the like. The sheets of material are first scored and punched as shown in FIGS. 6 and 7. FIG. 6 shows the top sheet which forms the upper frame member and FIG. 7 shows the bottom sheet which forms the lower frame member. The lower frame member 12 may define holes 13 which are positioned and sized to provide ample clearance for the wheels of a jack pallet. However, if the use of a jack pallet is not needed, the bottom sheet 12 could use the same design as the top sheet 11.

Figure 1:
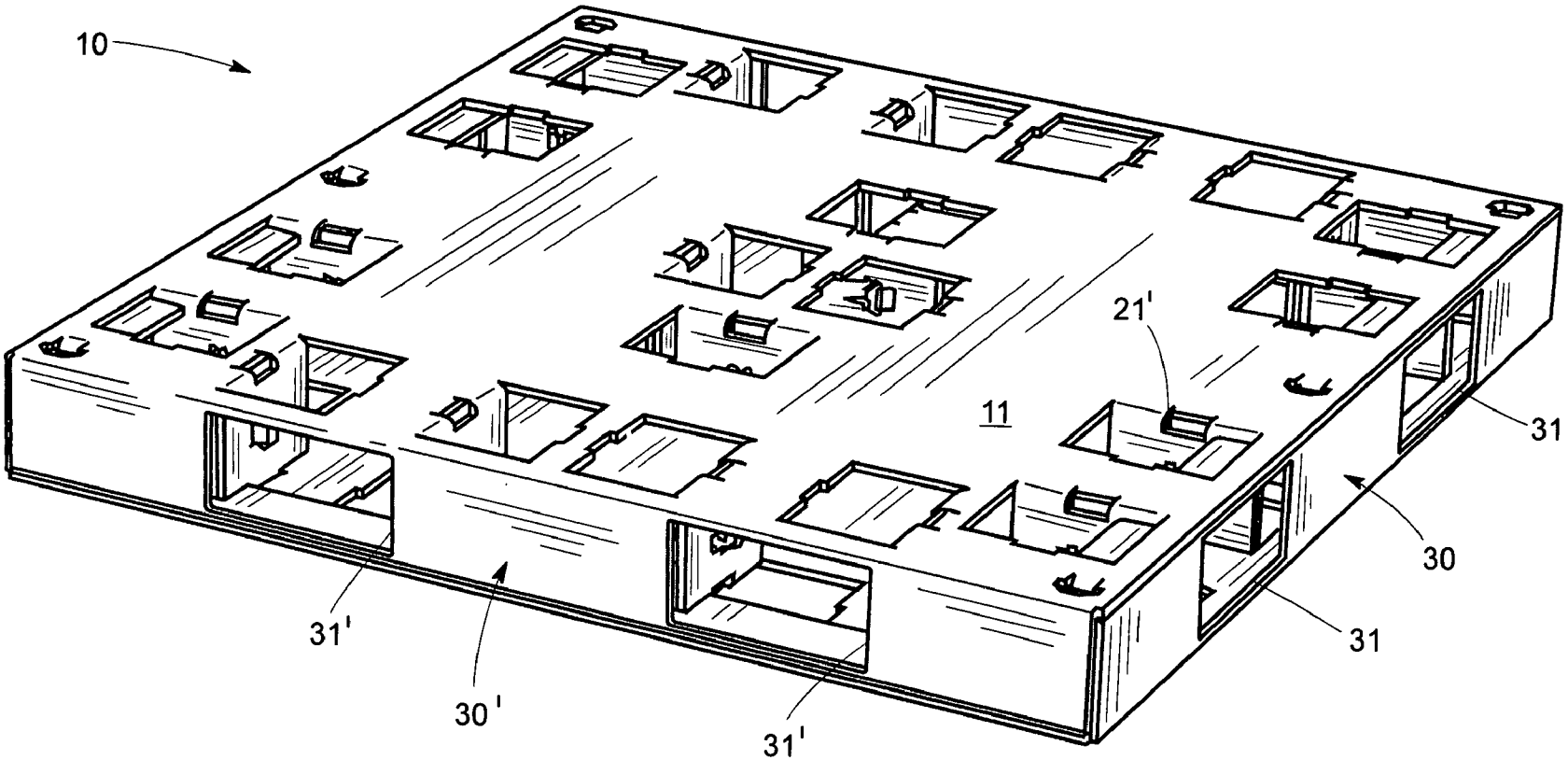
FIG. 1 is a top right side perspective view of the assembled pallet according to the present invention.
Figure 2:
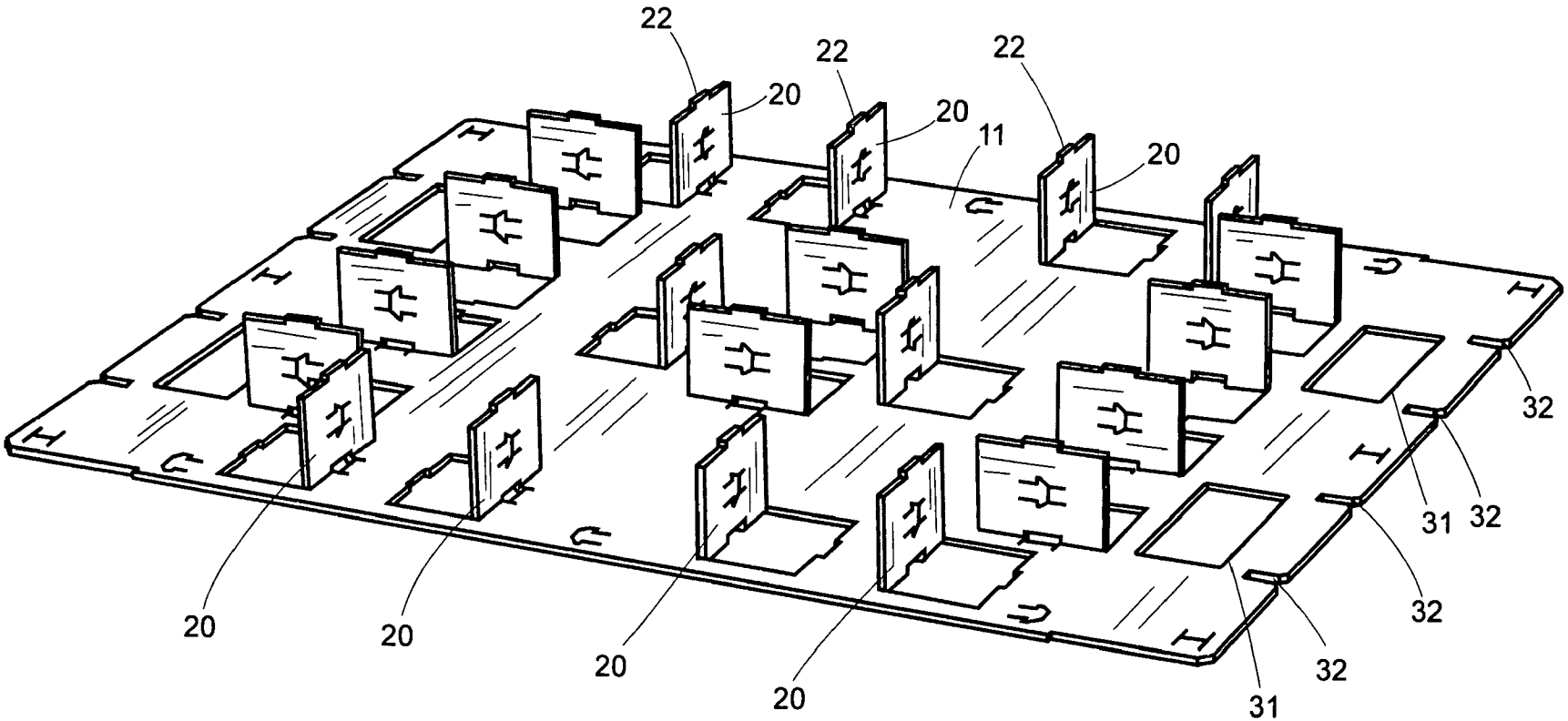
FIG. 2 is a top right side perspective view of one of the two frame members which in assembled relation form the pallet according to FIG. 1, the sheet of material from which the frame member is folded being shown in its preliminary folded state.

The sheets 11, 12 are scored with five types of patterns as is illustrated in FIGS. 6 and 7. The main cutouts are the column elements 20, 20'. (To help distinguish between identical cutouts on sheets 11 and 12, the cutouts on sheet 11 are marked by prime numbers.) The first step in assembly is to bend these column elements 20, 20' about 90 degrees as shown in FIG. 2. When the frame members 11 and 12 are properly positioned, as shown in FIGS. 3A, 3B, and 3C, each column element 20' of the upper frame member 11 is paired side by side with a column element 20 from the the lower frame member 12.

Figure 3A:
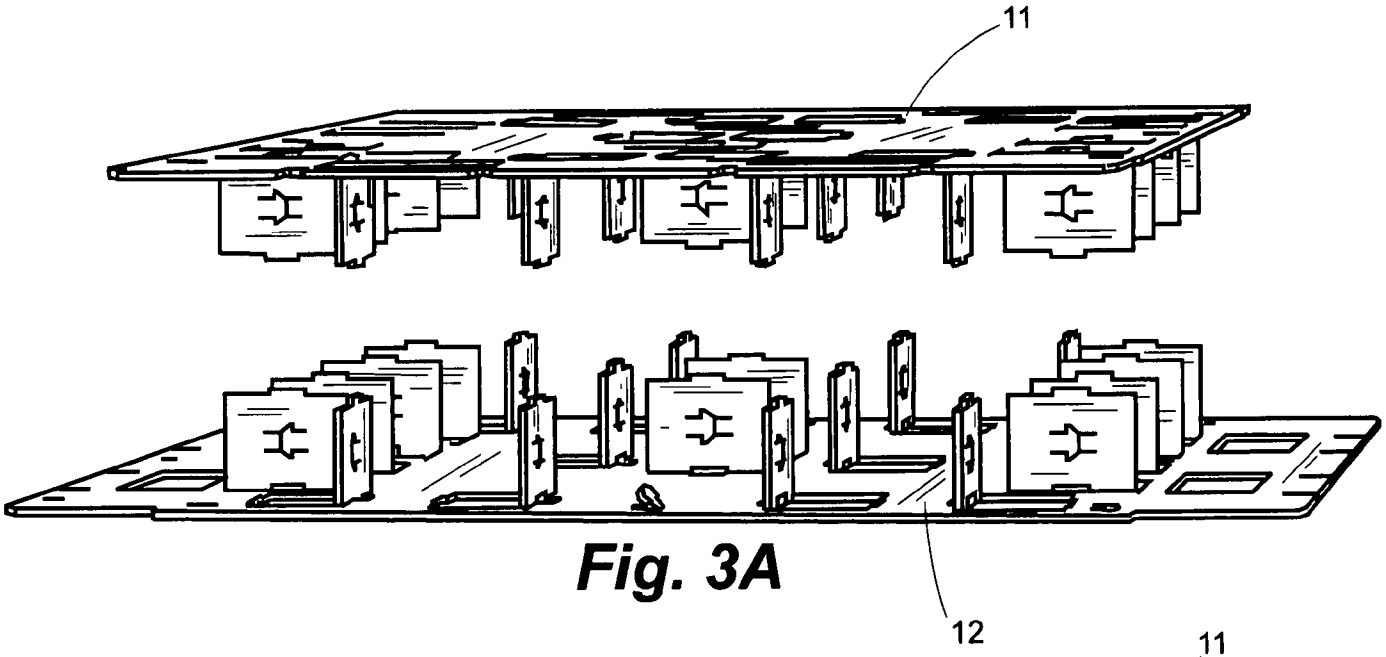
FIG. 3A is an exploded perspective view of the two frame members which in assembled relation form the pallet according to FIG. 1, portions of each frame member having been folded, prior to its being joined to the other frame member.
Figure 3B:
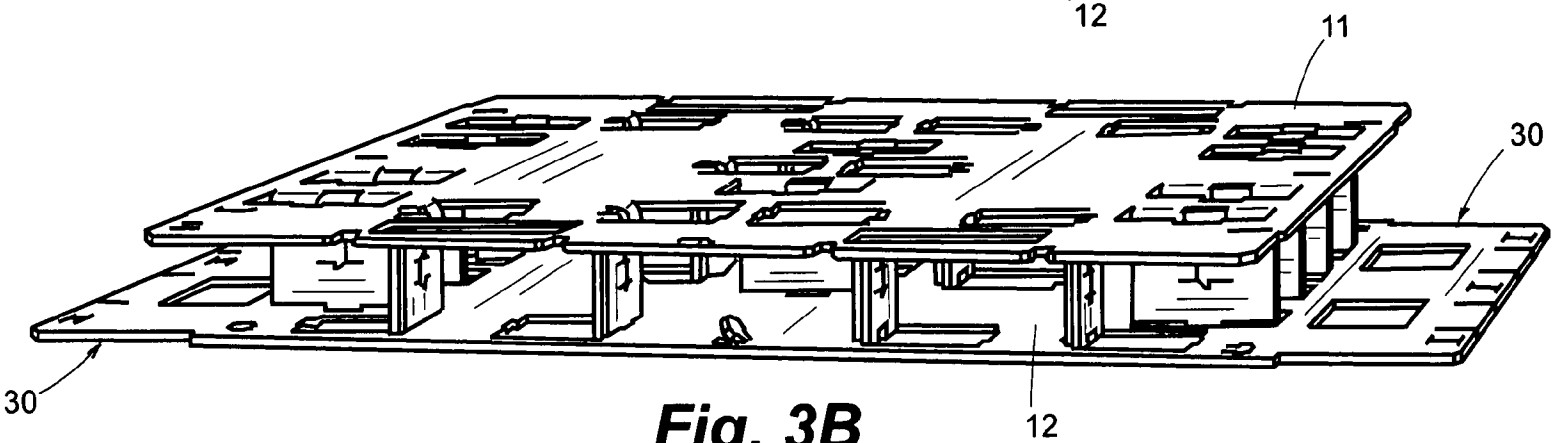
FIG. 3B is a perspective view of the two frame members according to FIG. 3A just after the first step has been taken to join them in assembled relation.
Figure 3C:
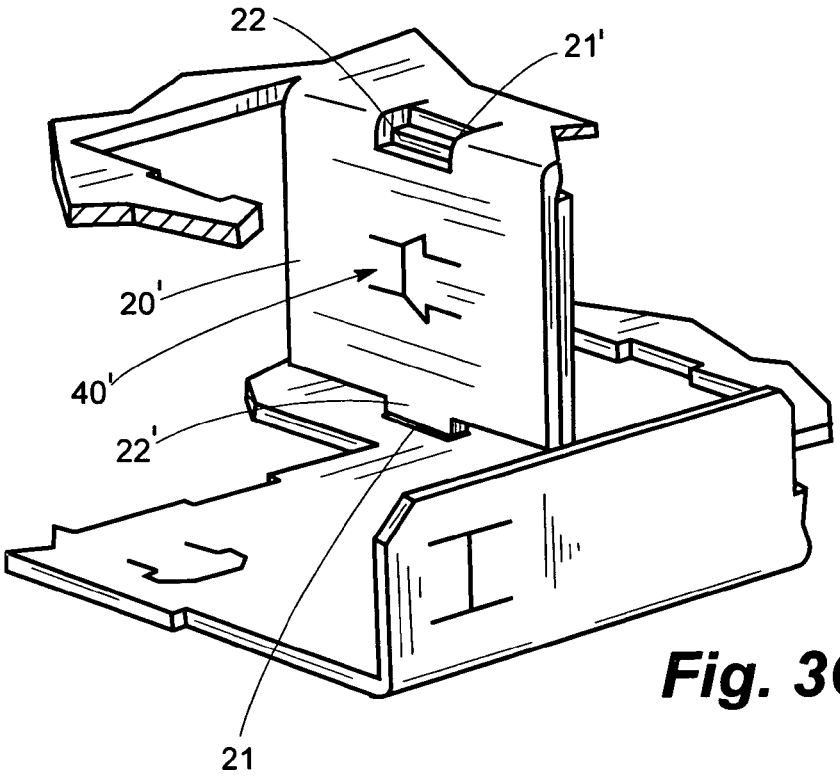
FIG. 3C is an enlarged perspective view of fragmentary portions of the two frame members according to FIG. 3B, the distal end of a column element in one frame member being shown as it is inserted into a supporting slot in the other frame member.

Among the features of each column element 20 are a notch 21 and a key 22 which on its distal end is sized for a close fit in a notch. 21' cut in the sheets as shown in detail in FIG. 3C. The key 22' of the column element 20' of the upper sheet 11 is slip fitted into one of the notches 21 of the lower sheet 12. Similarly, each key 22 on the column elements 20 of the lower sheet 12 is fastened into one of the notches 21' of the upper sheet 11.

The pallet is assembled when two sheets 11, 12 with their column elements in raised position as shown in FIG. 2 are aligned in such a way that when the top sheet 11 is raised above the lower sheet 12, its column elements 20' face and are disposed adjacent to the column elements 20 of the lower sheet as shown in FIG. 3A. The sheet 11 is then lowered as shown in FIG. 3B, and the column keys 22 are slip fitted into the respective notches 21' as shown in FIG. 3C.

Figure 4A:
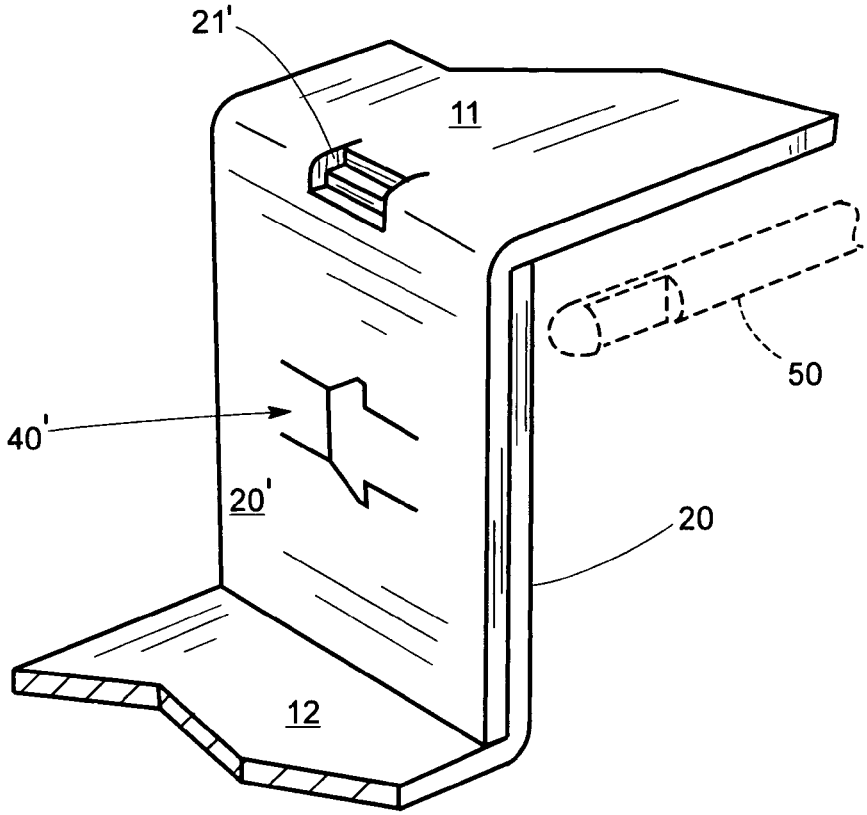
FIGS. 4A, 4B, 4C, 4D and 4E are enlarged perspective views of fragmentary portions of the two frame members according to FIG. 3B, a tool used to facilitate locking together tabs on contiguous column elements of the frame being shown in dashed lines and forming no part of the assembled pallet.
Figure 4B:
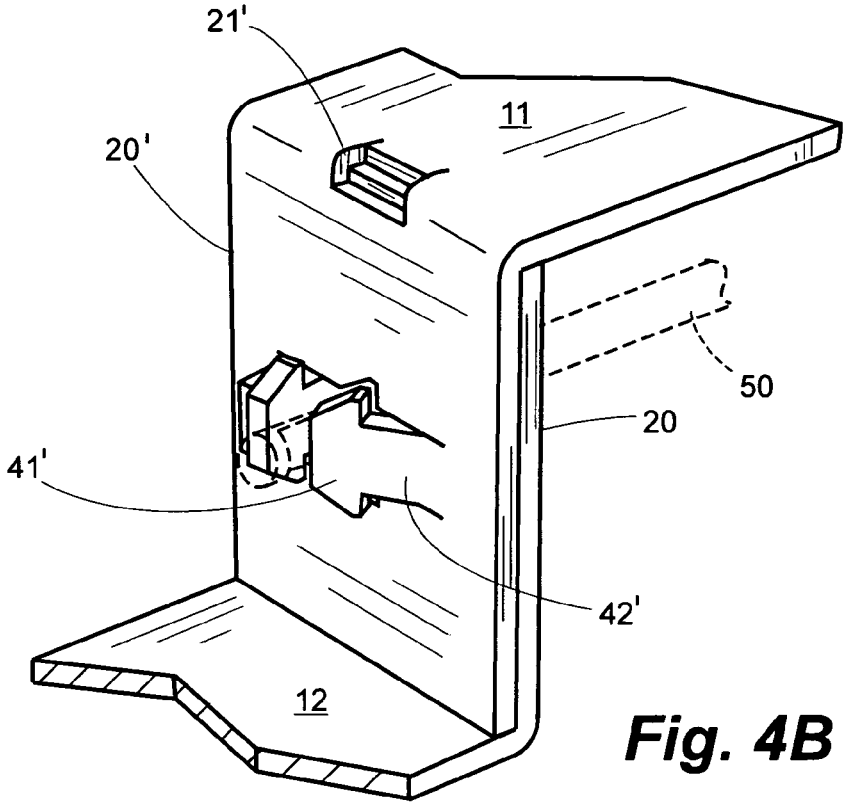
Figure 4C:
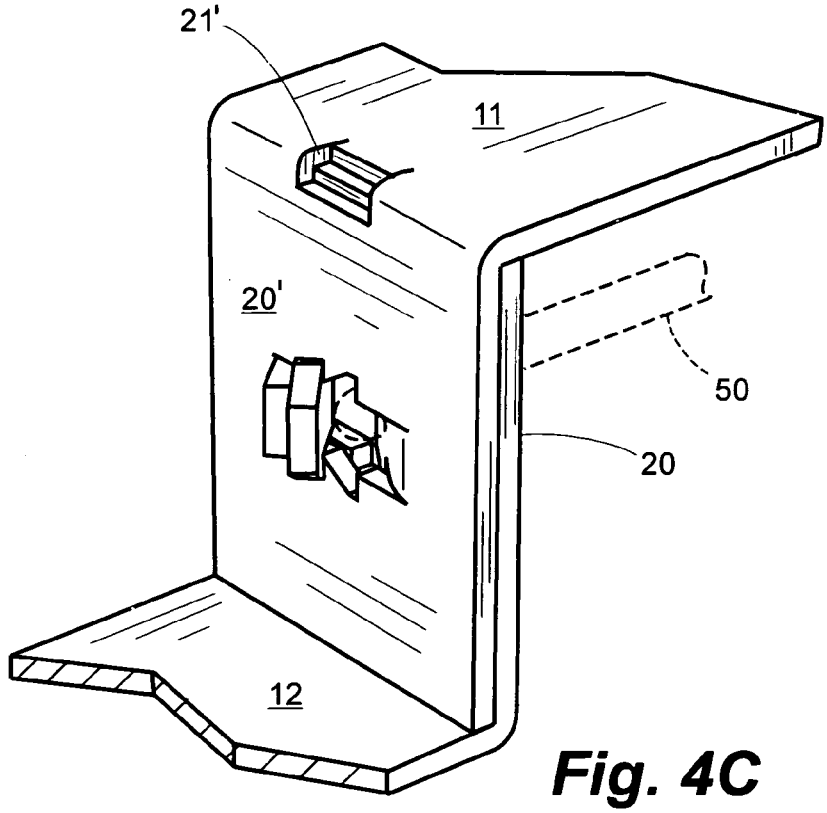
Figure 4D:
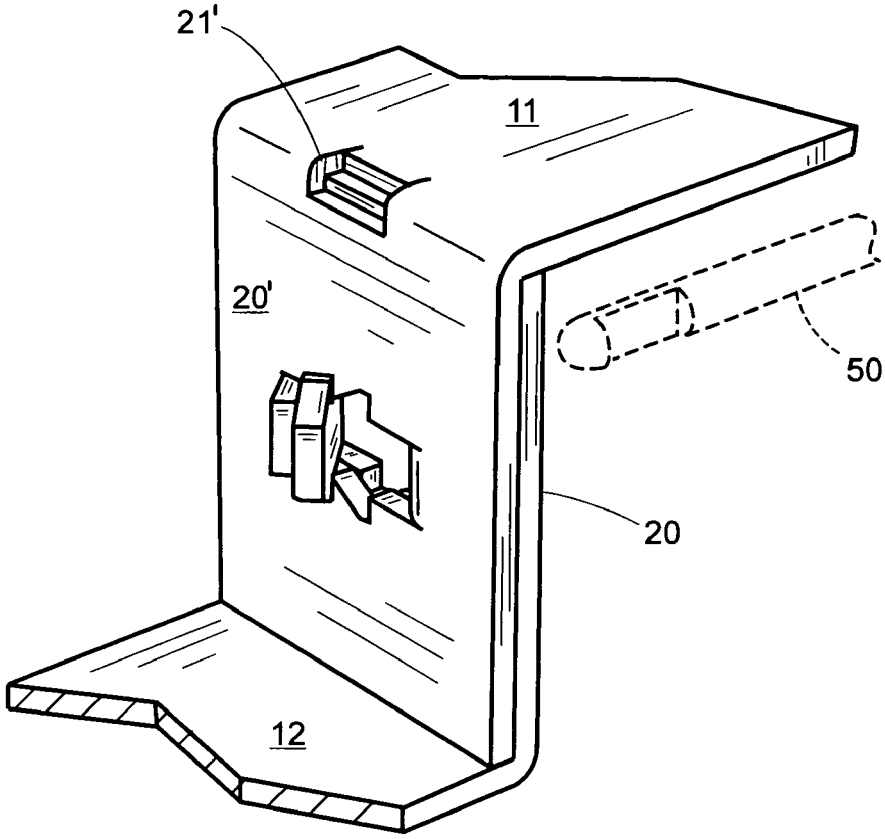
Figure 4E:
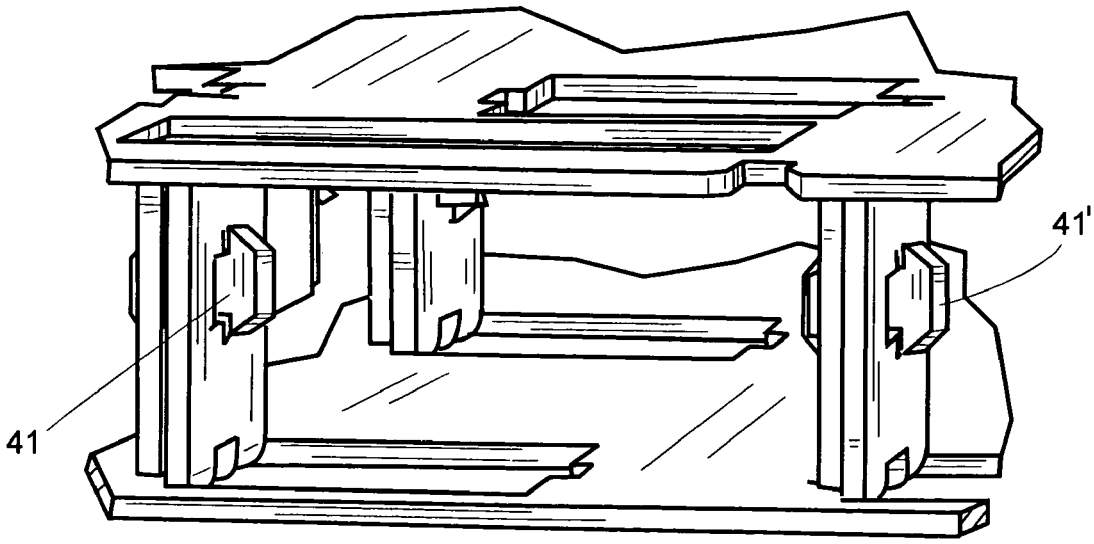

Further features of each column element 20, 20' include a locking tab 40 whose cutout roughly resembles a horizontally disposed "H" (FIG. 4A). The upper sheet 11 and lower sheet 12 are locked together by the locks 40 in each adjacent pair of column elements 20, 20'. When certain portions of the "H", such as the cross bar of the "H", are spread apart, a blunt arrow 41', that has barbs whose total width is greater than that of the space between the parallel arms of the "H", is defined (FIG. 4B). The material which occupied the space between the parallel arms of the "H" becomes the shaft 42' of the arrow on one column element 20' and the space itself becomes the opening for receiving the arrow on the adjacent column element 20 (FIG. 4B). Thus the shafts of the two locks 40 hold the two column elements together permanently by the barbs on their respective arrows.

This locking mechanism utilizing the tabs 40 can be activated manually for small applications or when a large demand for pallets exists, with the use of a machine tool 50 as illustrated in FIG. 4. It is also possible for the sheets 11 and 12 to be placed in a forming machine while still flat and for all of the cutouts to be punched and folded automatically, until a finished pallet is discharged from the machine. The applicant is in the process of developing such a machine that has specifications for assembly of this type of pallets at a high rate of speed.

Figure 5A:
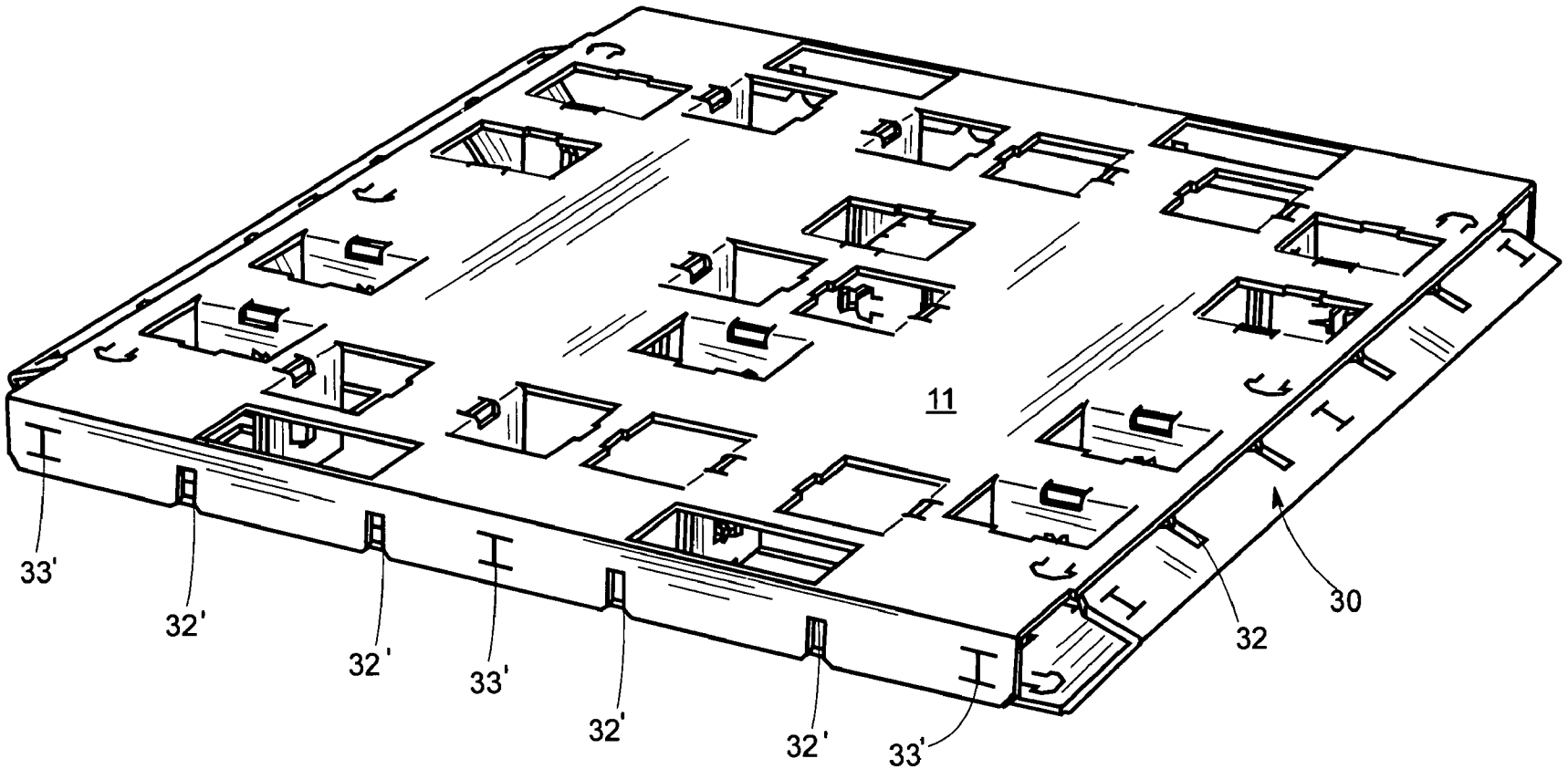
FIG. 5A is a perspective view of the pallet showing how the end flaps are inserted, the upper frame member having had its front edge flap first folded and the end flap of the lower frame element having had both its first and second fold completed and being inserted under the upper frame member.
Figure 5B:
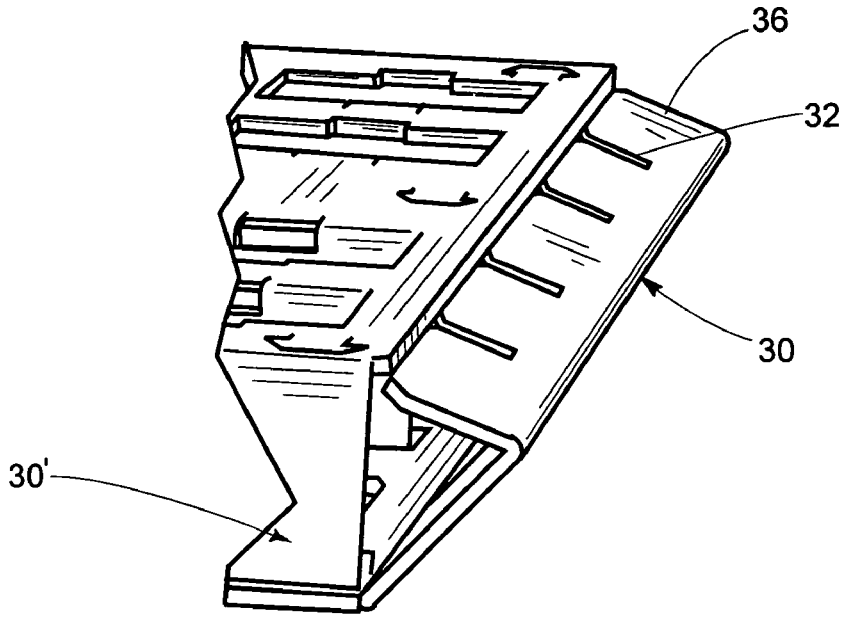
FIG. 5B is an enlarged view of FIG. 5A showing the lower frame member's end flap being inserted under the upper frame member.
Figure 5C:
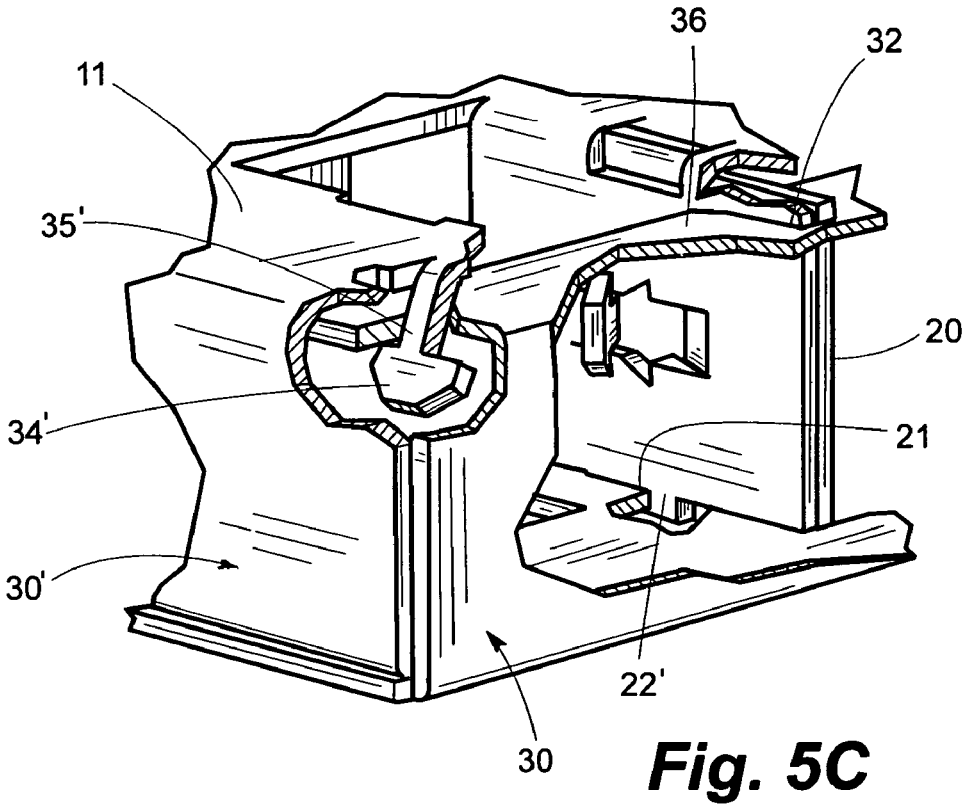

The final step of assembling the pallets is the assembly of end closures 30 as shown on FIG. 5. The end closures have three two types of cutouts: the large lifting fork cutouts 31, the end notches 32 sized to slip fit on a pair of adjacent end columns 20, 20' and a horizontal "H" cutout 33. The end closure 30 is double folded and the end tabs 36 are slid on the inside their respective cover sheets 11 or 12. The end closures 30 are permanently locked into position by the arrows 34 and shaft 35 are slid into their respective slots 33 (FIG. 5C). This end closure 30 not only gives a target for the fork lift forks but also strengthens the perimeter of the pallet.

It is understood that those skilled in the art may conceive modifications, additions, and deletions and/or changes in the preferred form described above without departing from the spirit and scope of the invention and its equivalents as set forth in the following claims.

What is claimed is:

1. A pallet which comprises:

(a) a top sheet and a bottom sheet of material defining upper and lower column elements, respectively; the upper column elements being folded perpendicularly, prior to use, to the top sheet and extending downwardly therefrom; the lower column elements being folded perpendicularly, prior to use, to the bottom sheet and extending upwardly therefrom; each upper column element, in assembled relation, being disposed contiguous with one of the lower column elements; and (b) means for locking each contiguous pair of upper and lower column elements together, the locking means comprising at least one arrow-shaped fastener, each fastener having a barbed head and a shaft, the shaft being attached to one of the column elements, each column element having a cutout which defines at least one slot, the barbed head of each fastener in a contiguous pair of column elements penetrating the slot of the contiguous column element in such a way that the barbed head and its shaft are locked into place, making each contiguous pair of column elements into a rigid structure.

2. The pallet according to claim 1, wherein the top and bottom sheets, in assembled relation, define top and bottom sides, respectively, and which further comprises perimeter portions of the top and bottom sheets being double folded and tucked between the top and bottom sides to form a closure, thereby strengthening the pallet.

3. The pallet according to claim 2, which further comprises the top and bottom sheets defining a plurality of arrow-shaped fasteners and slots which are spaced apart from the column elements and disposed along edges of the top and bottom sides, each fastener so disposed having a barbed head and a short shaft which, in assembled relation, are locked into one of the slots spaced apart from the column elements, thereby locking the perimeter portions themselves into place.

4. A pallet which comprises:

(a) a top sheet and a bottom sheet of material defining upper and lower column elements, respectively; the upper column elements being folded perpendicularly, prior to use, to the top sheet and extending downwardly therefrom; the lower column elements being folded perpendicularly, prior to use, to the bottom sheet and extending upwardly therefrom; each upper column element, in assembled relation, being disposed contiguous and side by side with one of the lower column elements; and (b) means for locking each contiguous pair of upper and lower column elements together, the locking means comprising at least one fastener, each fastener and one of the column elements forming a single, unitary piece.

5. The pallet according to claim 4, wherein the top and bottom sheets are made of corrugated paper boards.

6. The pallet according to claim 4, wherein the top and bottom sheets are made of a plastic material.

7. The pallet according to claim 4, wherein the top and bottom sheets are made of a ductile metal.

8. The pallet according to claim 4, wherein the top and bottom sheets are made of any combination of corrugated paper, plastic or metal.

9. A pallet assembly, which comprises:

(a) upper and lower frame members having top and bottom sides, respectively, each of the top and bottom sides being compatible in footprint to the pallet assembly itself;

(b) a plurality of upper and lower column elements, the upper column elements being fabricated as a single, unitary piece with the top side and being disposed perpendicularly thereto in assembled relation, the lower column elements being fabricated as a single, unitary piece with the bottom side and being disposed perpendicularly thereto in assembled relation; the upper and lower column elements being arrayed in contiguous pairs, each upper column element in such a pair being disposed side by side with a lower column element; and (c) means for locking each contiguous pair of upper and lower column elements together, the locking means including first and second arrow-shaped fasteners formed as unitary pieces with the upper and lower column elements, respectively; each fastener having a barbed head and a short shaft, the upper and lower column elements defining first and second slots for receiving the barbed heads of the second and first fasteners, respectively; each slot having approximately the same width as the shaft of the fastener whose barbed head the slot receives so that in each contiguous pair of upper and lower column elements, the barbed heads of the first and second fasteners anchored by their shafts to the upper and lower column elements, respectively, can be locked into slots defined by the lower and upper column elements, respectively, forming a rigid structure.

* * * * *